US007003915B2

(12) United States Patent
Yokomori

(10) Patent No.: US 7,003,915 B2
(45) Date of Patent: Feb. 28, 2006

(54) POWER DEVICE FOR VEHICLE SLIDING DOOR

(75) Inventor: Kazuhito Yokomori, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 15 days.

(21) Appl. No.: 10/606,927

(22) Filed: Jun. 27, 2003

(65) Prior Publication Data

US 2005/0039405 A1 Feb. 24, 2005

(30) Foreign Application Priority Data

Jun. 28, 2002 (JP) ..... 2002-191539

(51) Int. Cl.
*E05F 11/00* (2006.01)

(52) U.S. Cl. ..... 49/360; 49/280

(58) Field of Classification Search ..... 49/279, 49/280, 360; 296/155; 74/724, 665 H, 665 R; 192/48.2, 48.9, 84.2
See application file for complete search history.

(56) References Cited

U.S. PATENT DOCUMENTS 5,688,019 A * 11/1997 Townsend ..... 296/155
5,832,669 A * 11/1998 Mizuki et al. ..... 49/360
6,276,743 B1 * 8/2001 Jyawook et al. ..... 296/155
2002/0158489 A1 * 10/2002 Rogers et al. ..... 296/155

* cited by examiner

*Primary Examiner*—Jerry Redman
(74) *Attorney, Agent, or Firm*—Browdy and Neimark, PLLC

(57) ABSTRACT

A cylindrical worm 25 is attached to an output shaft of a motor, a first worm wheel 26 and a second worm wheel 27 are disposed on both the sides of the axial center of the cylindrical worm 25, the first worm wheel 26 and a wire drum are supported by a first support shaft 28, and the second worm wheel 27 and a swing arm are supported by a second support shaft 32. A first clutch is interposed between the first worm wheel 26 and the wire drum, a second clutch is interposed between the second worm wheel 27 and the swing arm, and the swing arm and the wire drum are rotated by controlling the first and second clutches with the motor rotating continuously.

5 Claims, 9 Drawing Sheets

POWER DEVICE FOR VEHICLE SLIDING DOOR

FIELD OF THE INVENTION

The present invention relates to a power device for a vehicle sliding door, and more particularly, to a power device for sliding a door and releasing the door from a latched state.

DESCRIPTION OF THE RELATED ART

Conventional vehicle sliding doors may be concurrently provided with a power slide device for sliding a sliding door in a door-opening direction and in a door-closing direction by motor power, a power close device for moving the sliding door located at a half-latched position to a full-latched position by motor power, a power release device for unlatching a door latch unit of the sliding door by motor power, and the like.

FIG. 1 shows a relation among three power devices used between a full-closed position and a full-open position of a sliding door, wherein when the sliding door is to be opened, first, a door latch unit of the sliding door is released (unlatched) by a power release device, and thereafter the sliding door is slid to a full-open position by a power slide device.

Further, when the sliding door is to be closed, the door is slid from the full-open position toward a half-latched position by the power slide device, and thereafter when the door reaches the half-latched position, the door is moved to a full-latched position by actuating a power close device.

Although the three power devices are actuated as described above, since the power close device is a device for rotating a latch of the door latch unit and the power release device is a device for rotating a ratchet of the door latch unit, there has been also developed a power device that is arranged to constitute these two power devices by a single common motor.

However, when the power close device and the power release device are composed of the single motor, a problem arises in that a heavy load is placed on a battery. That is, in the three power devices, since the outputs required to the power close device and the power slide device are greatly larger than that required to the power release device, when the power close device and the power slide device are combined as described above, the power release device shares a high output motor with the power close device. As shown in FIG. 1, since the power release device and the power slide device have such a relation therebetween that the power slide device is actuated just after the power release device is actuated, two high output motors are started almost simultaneously, thereby a very high start current acts on the battery as a load.

SUMMARY OF THE INVENTION

Accordingly, an object of the present invention is to provide a power device that can sequentially actuate a plurality of power devices by continuously rotating a single motor.

DESCRIPTION OF THE PREFERRED EMBODIMENTS

Figure 1:
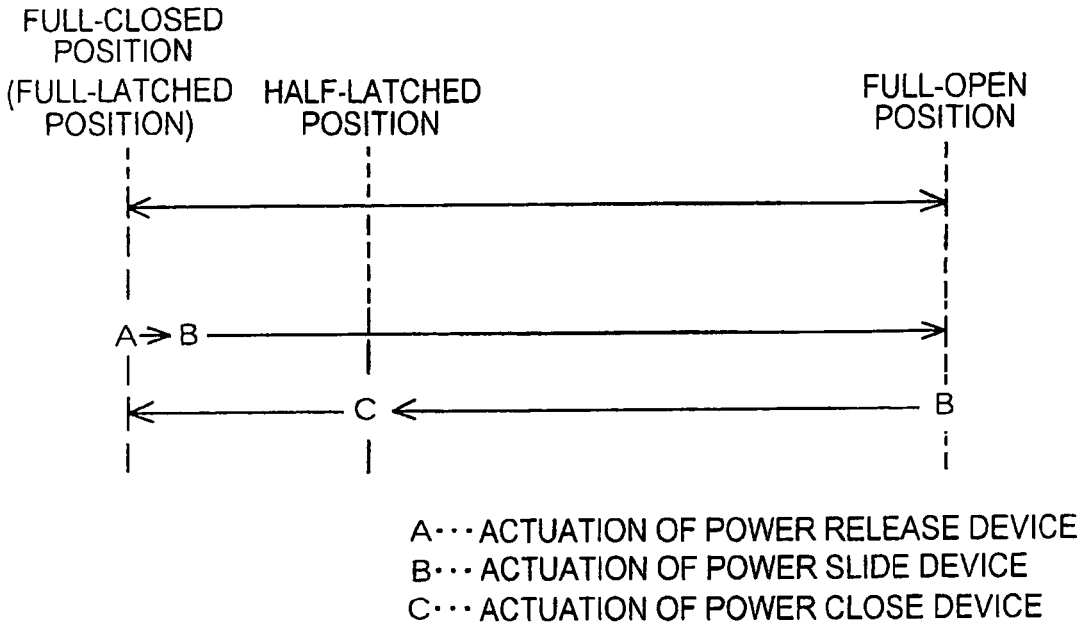
FIG. 1 is a view showing a relation between power devices used between a full-closed position and a full-open position of a conventional sliding door.
Figure 2:
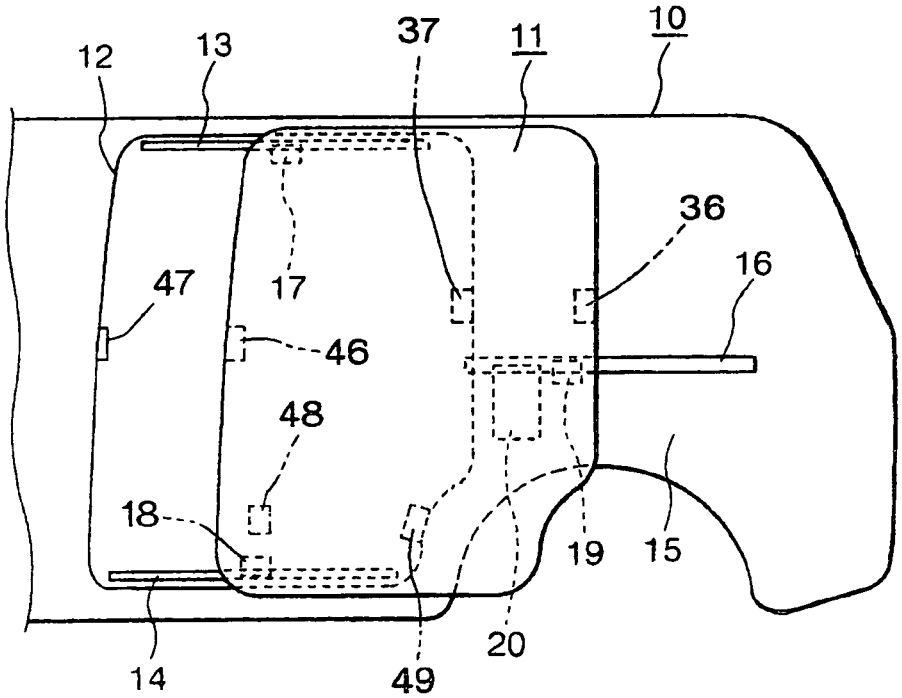
FIG. 2 is a side view of a vehicle provided with a power unit of the present invention.

An embodiment of the present invention will be explained. FIG. 2 shows a vehicle body 10, a sliding door 11 slidably attached to the vehicle body 10, and a door ingress/egress aperture 12 that can be closed by the sliding door 11. An upper rail 13 is fixed to the vehicle body 10 in the vicinity of an upper portion of the door aperture 12, a lower rail 14 is fixed to the vehicle body 10 in the vicinity of a lower portion of the door aperture 12, and a center rail 16 is fixed to a quarter panel 15 that is a rear side surface of the vehicle body 10. The sliding door 11 is provided with an upper bracket 17 which is slidably engaged with the upper rail 13, a lower bracket 18 which is slidably engaged with the lower rail 14, and a center bracket 19 which is slidably engaged with the center rail 16. It is preferable that the respective brackets 17, 18, and 19 be pivotally mounted on the sliding door 11 so that they are free to swing, and the sliding door 11 is slidable in a door-opening direction and a door-closing direction by engagement of these brackets with the rails.

Figure 3:
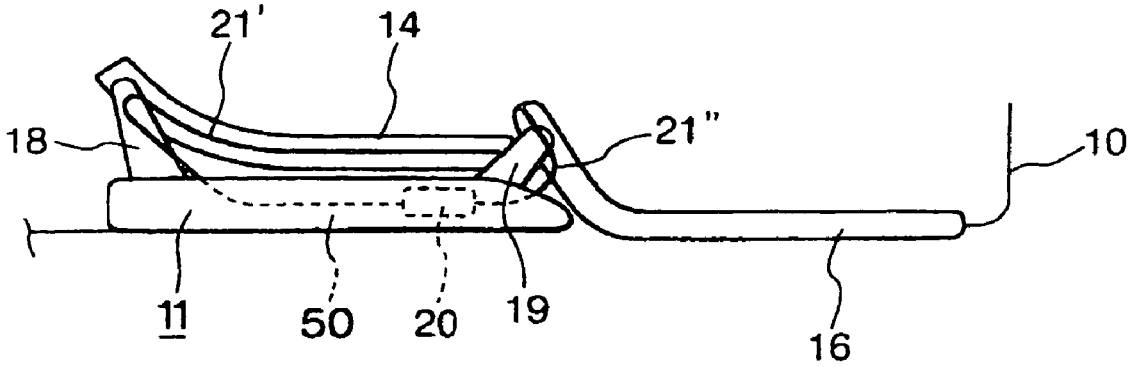
FIG. 3 is a view showing a relation between the power unit and wire cables, wherein a sliding door is closed.
Figure 4:
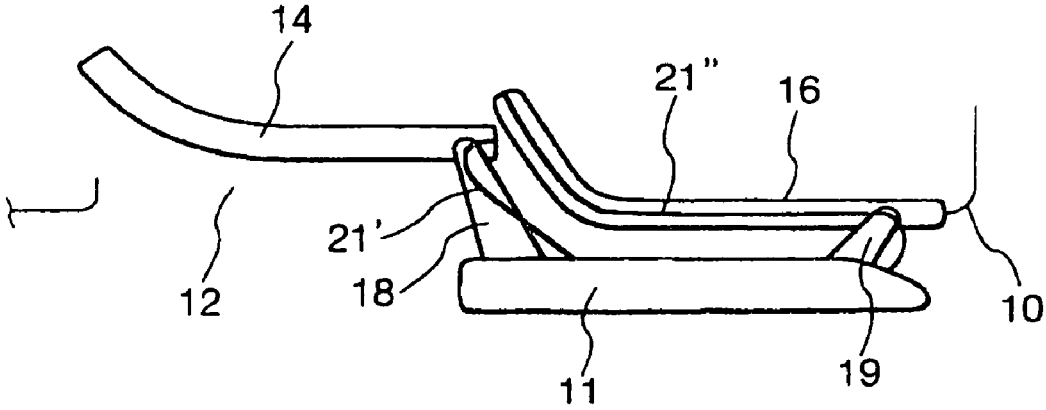
FIG. 4 is a view showing a relation between the power unit and the wire cables, wherein the sliding door is opened.
Figure 5:
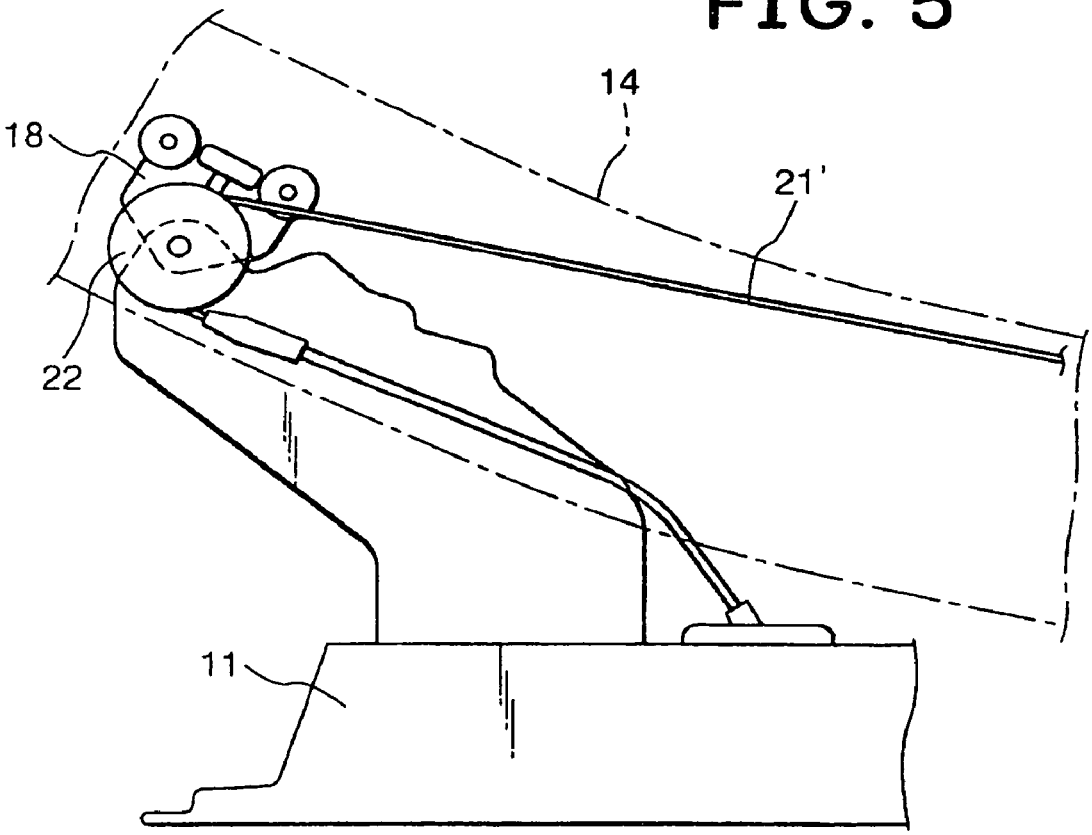
FIG. 5 is an enlarged plan view of a lower rail, and a lower roller bracket of the sliding door.
Figure 6:
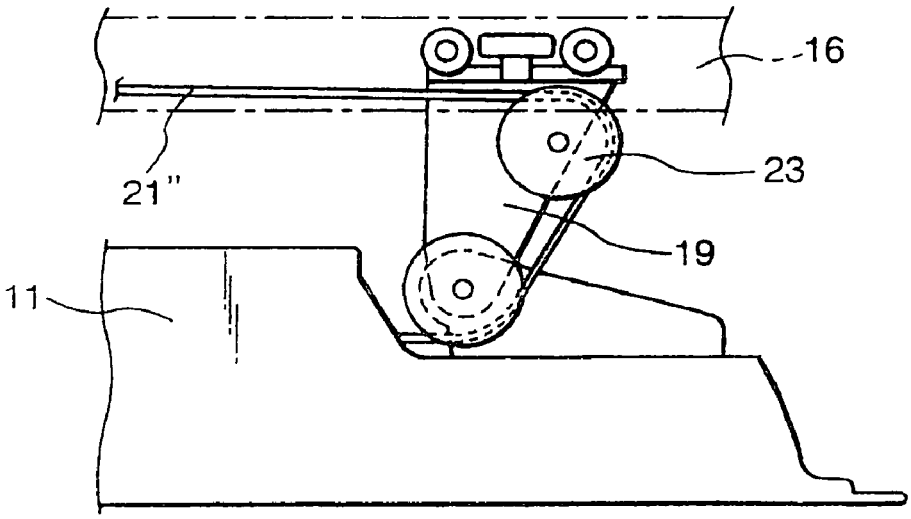
FIG. 6 is an enlarged plan view of a center rail, and a center roller bracket of the sliding door.

As shown in FIG. 3, a power unit 20 is disposed in an inner space 50 of the sliding door 11, and the power unit 20 has motor power. The power unit 20 shown in FIGS. 7 and 8 has a power slide function and a power release function, and both the functions share a single motor 24. However, a combination of power functions is not limited to the above combination, and it is also possible to combine the power slide function with a power close function, and to combine these three functions, that is, the power slide function, the power close function, and the power release function.

The power unit 20 is provided with a wire drum 30 that pulls and draws out two wire cables, i.e. a door opening cable 21' and a door closing cable 21" which are connected to the wire drum 30 at the bases ends thereof. When the wire drum 30 is rotated in the door-opening direction, the door opening cable 21' is taken up, and the door closing cable 21" is drawn out, and when the wire drum 30 is rotated in the door-closing direction, the door opening cable 21' is drawn out, and the door closing cable 21" is taken up.

The door opening cable 21' is drawn out from a lower front position of the sliding door 11, that is, from a position in the vicinity of the lower bracket 18 toward the vehicle body (toward the lower bracket 18) to the outside of the sliding door 11. The lower bracket 18 is provided with a pulley 22 having a vertical axial center, and the door opening cable 21', which has been drawn out from the sliding door 11, passes through a front side of the pulley 22, then extends rearward in the lower rail 14, and is fixed to a rear end of the lower rail 14 or to the vehicle body 10 in the vicinity of the rear end. With the above constitution, when the door opening cable 21' is taken up in a door closed state, the sliding door 11 slides rearward (in the door-opening direction) through the lower bracket 18.

The door closing cable 21" is drawn out from the central portion in an up/down direction of the sliding door 11 on the rear side thereof, i.e. from a position in the vicinity of the center bracket 19 toward the vehicle body (toward the center bracket 19) to the outside of the sliding door 11. The center bracket 19 is provided with a pulley 23 having a vertical axial center, and the door closing cable 21", which has been drawn out from the sliding door 11, passes through a rear side of the pulley 23, then extends forward in the center rail 16, and is fixed to a front end of the center rail 16 or to the vehicle body 10 in the vicinity of the front end. With the above constitution, when the door closing cable 21" is taken up in a door open state, the sliding door 11 slides forward (in the door-closing direction) through the center bracket 19.

Figure 7:
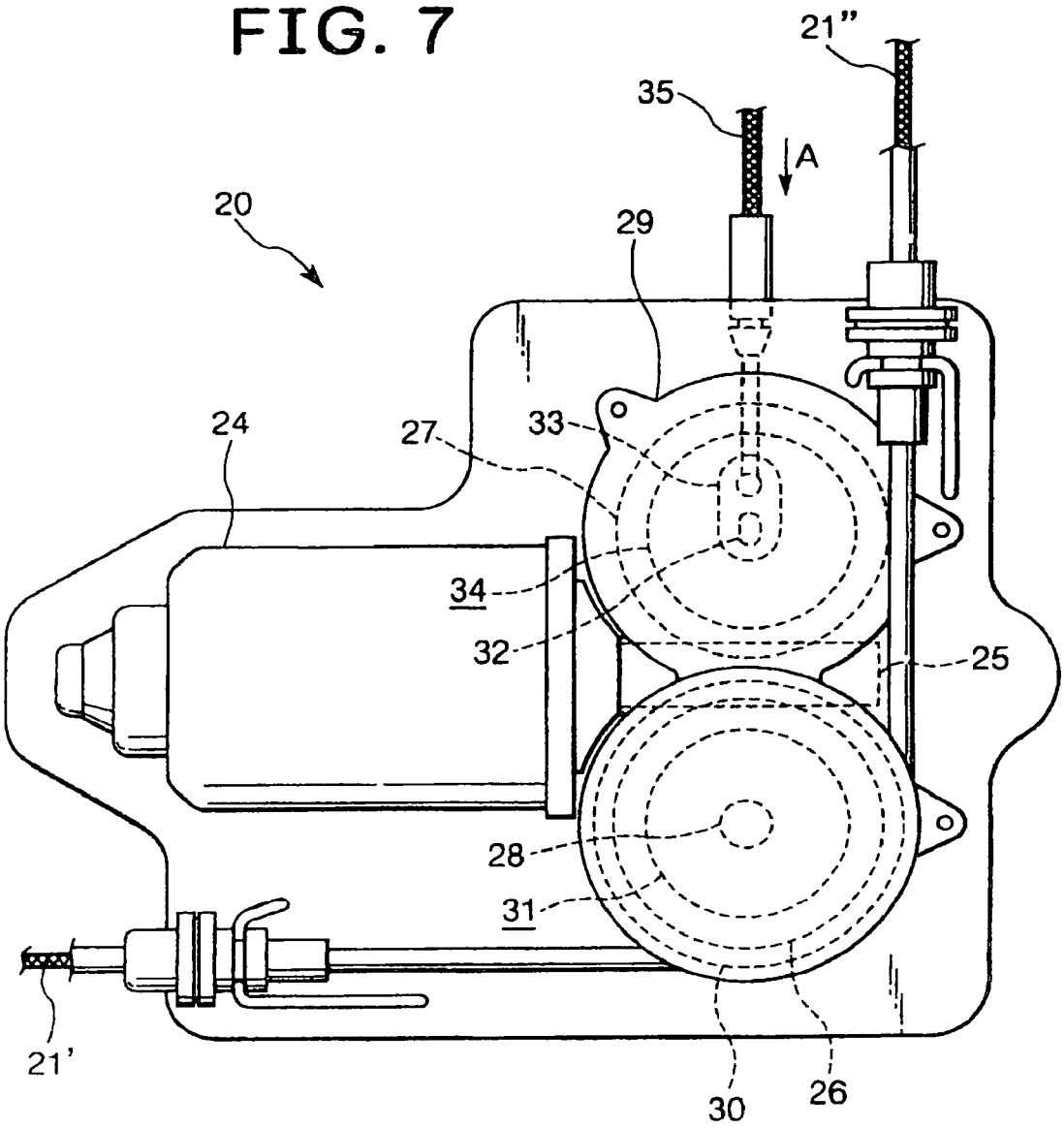
FIG. 7 is a side view of a power unit having a power release function and a power slide function.
Figure 8:
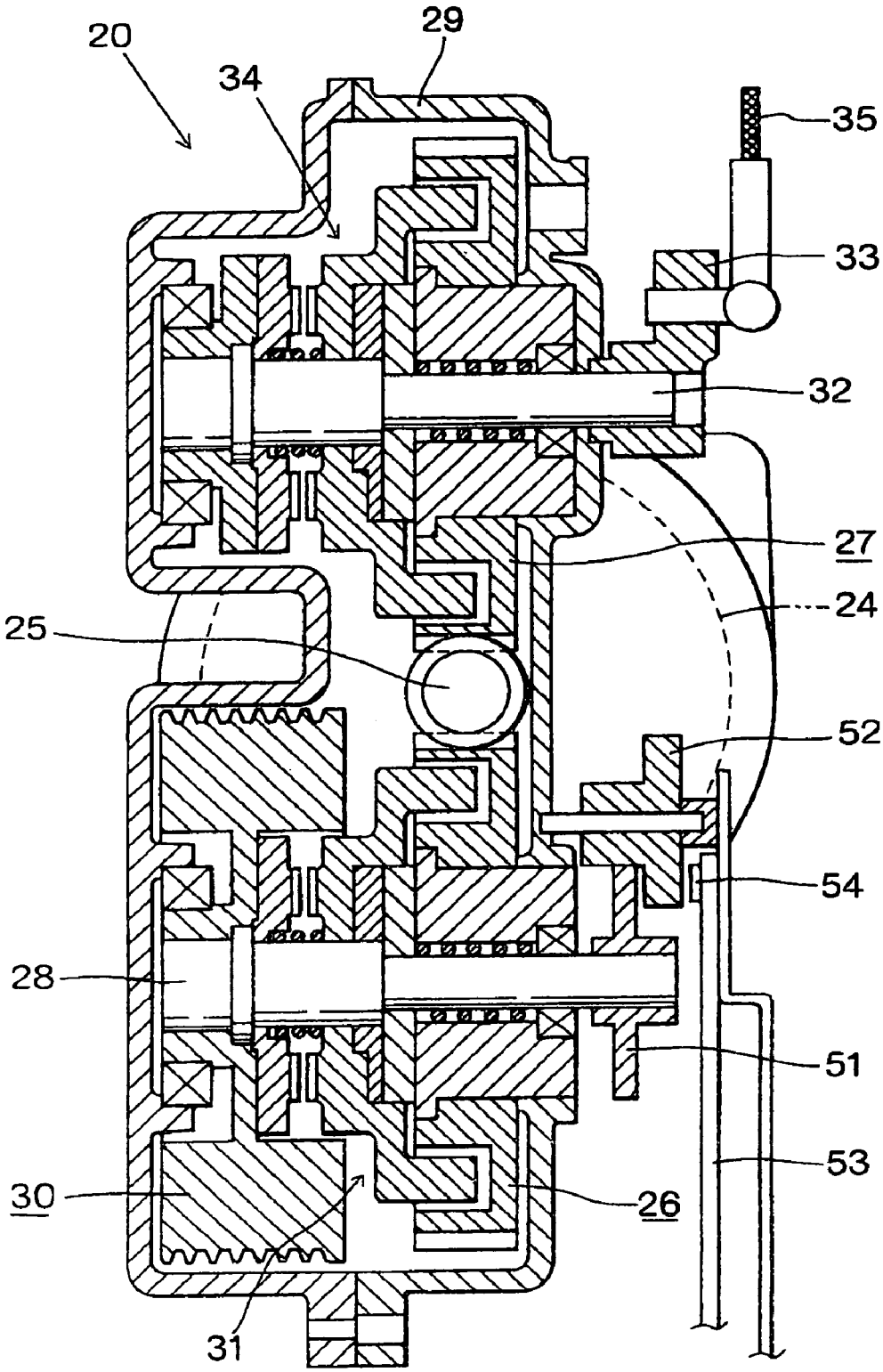
FIG. 8 is a sectional view of the power unit.

In FIGS. 7 and 8, a cylindrical worm 25 is attached to an output shaft of the high output motor 24, and first and second worm wheels 26 and 27 are provided on both the sides of the cylindrical worm 25 so that they are meshed with the cylindrical worm 25, respectively. The first worm wheel 26 is pivotally mounted on a case 29 of the power unit 20 by a first support shaft 28, and the wire drum 30 is also pivotally mounted on the first support shaft 28. A first clutch 31 is interposed between the first worm wheel 26 and the wire drum 30. When the first clutch 31 is turned on, the rotation of the first worm wheel 26 is transmitted to the wire drum 30, and when it is turned off, the wire drum 30 is placed in a free state with respect to the first worm wheel 26. Accordingly, in FIG. 7, when the first clutch 31 is turned on while the first worm wheel 26 is being rotated clockwise by the forward rotation of the motor 24, the wire drum 30 is also rotated clockwise, thereby the door opening cable 21' is drawn out, and the door closing cable 21" is taken up. On the contrary, when the first clutch 31 is turned on while the first worm wheel 26 is being rotated counterclockwise by the rearward rotation of the motor 24, the wire drum 30 is also rotated counterclockwise, thereby the door opening cable 21' is taken up, and the door closing cable 21" is drawn out. The power unit 20 has a power slide function for taking up and drawing out the door opening cable 21' and the door closing cable 21" by rotating the wire drum 30 by the power of the motor 24.

The second worm wheel 27 is pivotally mounted on the case 29 of the power unit 20 by a second support shaft 32. One of the ends of the second support shaft 32 is caused to pass through the case 29 and to project to the outside, and a swing arm 33 is fixed to the projecting end of the second support shaft 32. A second clutch 34 is interposed between the second worm wheel 27 and the second support shaft 32. When the second clutch 34 is turned on, the rotation of the second worm wheel 27 is transmitted to the swing arm 33 through the second support shaft 32, and when the second clutch 34 is turned off, the swing arm 33 is placed in a free state with respect to the second worm wheel 27. The first and second clutches 31 and 34 are clutches that are turned on and off by electric control.

Figure 10:
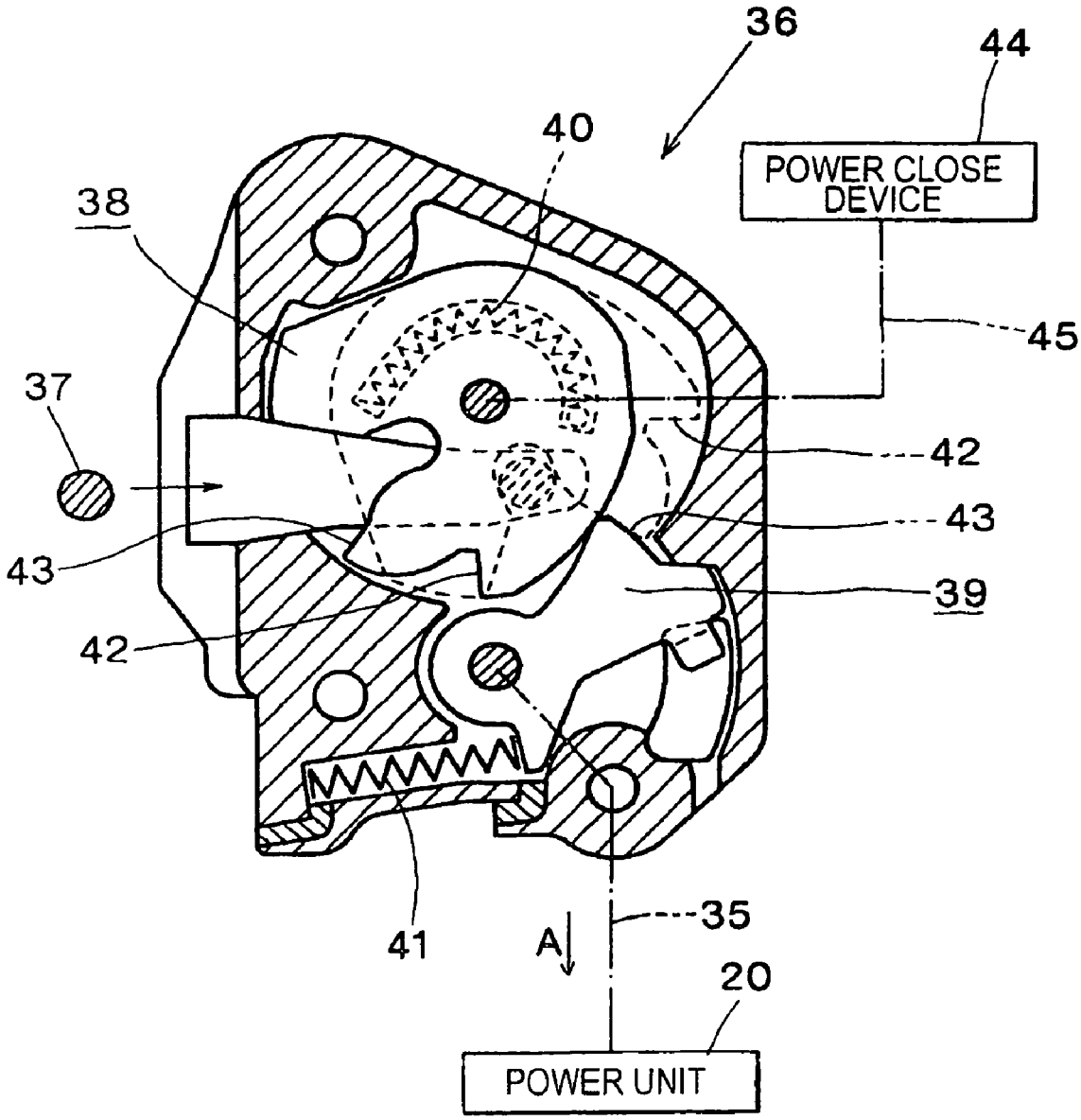
FIG. 10 is a sectional view of a door latch unit.

The swing arm 33 has a rotation end to which an end of a release cable 35 is locked. As shown in FIG. 10, the other end of the release cable 35 is coupled with a door latch unit 36 of the sliding door 11, and when the release cable 35 is pulled in the direction of an arrow A by swinging the swing arm 33, the door latch unit 36 is released. The typical door latch unit 36 shown in FIG. 10 includes a latch 38 which is engaged with a striker 37 fixed to the vehicle body 10, and a ratchet 39 that is engaged with the latch 38. The latch 38 is urged in a clockwise direction by the elastic force of a latch spring 40, and the ratchet 39 is urged in a counterclockwise direction by the elastic force of a ratchet spring 41. When the sliding door 11 is moved in the door-closing direction, the latch 38 is abutted against the striker 37 and rotated from a door open position (unlatched position), which is shown by a solid line, to a full-latched position (position shown by a dotted line), at which the ratchet 39 is engaged with a full-latch step 43 of the latch 38, through a half-latched position, at which the ratchet 39 is engaged with a half-latch step 42 of the ratchet 39, and when the latch 38 reaches the full-latched position, the sliding door 11 is completely closed. The release cable 35 is operatively coupled with the ratchet 39, and when the release cable 35 is pulled in the direction of the arrow A, the ratchet 39 is released from the latch 38, and the door latch unit 36 is unlatched, thereby the sliding door 11 is placed in an openable state. The power unit 20 has a power release function for unlatching the door latch unit 36 by swinging the swing arm 33 by the power of the motor 24.

Reference numeral 44 denotes a power close device attached to the inside of the sliding door 11, and the power close device 44 has motor power that is transmitted to the latch 38 of the door latch unit 36 through a close cable 45. In FIG. 10, the power close device 44 is shown independently of the power unit 20. When the latch 38 is located at the half-latched position by the movement of the sliding door 11 in the door-closing direction, the power close device 44 pulls the close cable 45 and rotates the latch 38 from the half-latched position to the full-latched position, thereby the sliding door 11 is completely closed.

The door latch unit 36 is disposed at a rear end of the sliding door 11 and achieves a function for keeping the sliding door 11 in a door closed state in cooperation with the striker 37. Further, the sliding door 11 may be also provided with a front latch unit 46, which has a latch and a ratchet similar to those of the door latch unit 36, at the front end thereof. If the sliding door 11 is provided with the two latch units, the other end side of the release cable 35 is branched, and one of the branched other ends of release cable 35 is coupled with the ratchet of the front latch unit 46 so that both the latch units 36 and 46 are unlatched by pulling the release cable 35. Reference numeral 47 denotes a front striker which is fixed to the vehicle body 10 and with which the latch of the front latch unit 46 is engaged.

Further, the sliding door 11 may be provided with a full-open position holder 48 having a latch and ratchet. When the sliding door 11 is moved to the full-open position by being slid in the opening direction, the latch of the full-open position holder 48 is engaged with a full-open striker 49 fixed to the vehicle body and keeps the sliding door 11 at the full-open position. When the latch/ratchet type full-open position holder 48 is used, an branched end of the release cable 35 is coupled with the ratchet of the full-open position holder 48 so that the full-open position holder 48 is unlatched by pulling the release cable 35.

In FIG. 8, one of the ends of the first support shaft 28 is caused to pass through the case 29 and to project to the outside, a gear 51 is fixed to the projecting end of the first support shaft 28 and meshed with a rotary member 52. When the first support shaft 28 is rotated by the rotation of the wire drum 30, the rotary member 52 is rotated in association with the first support shaft 28. Reference numeral 53 denotes a control board of the power unit 20, and a sensor 54, which detects the amount of rotation, rotating direction, and rotating speed of the rotary member 52, is directly mounted on the control board 53. A preferable embodiment of the rotary member 52 is a rotary member on which S- and N-pole magnetic materials are disposed circumferentially at intervals, and the sensor 54 is a hole IC sensor for detecting magnetism. Mounting the sensor 54 directly on the control board 53 is advantageous to external electric noise because no harness is necessary for the sensor 54.

Figure 9:
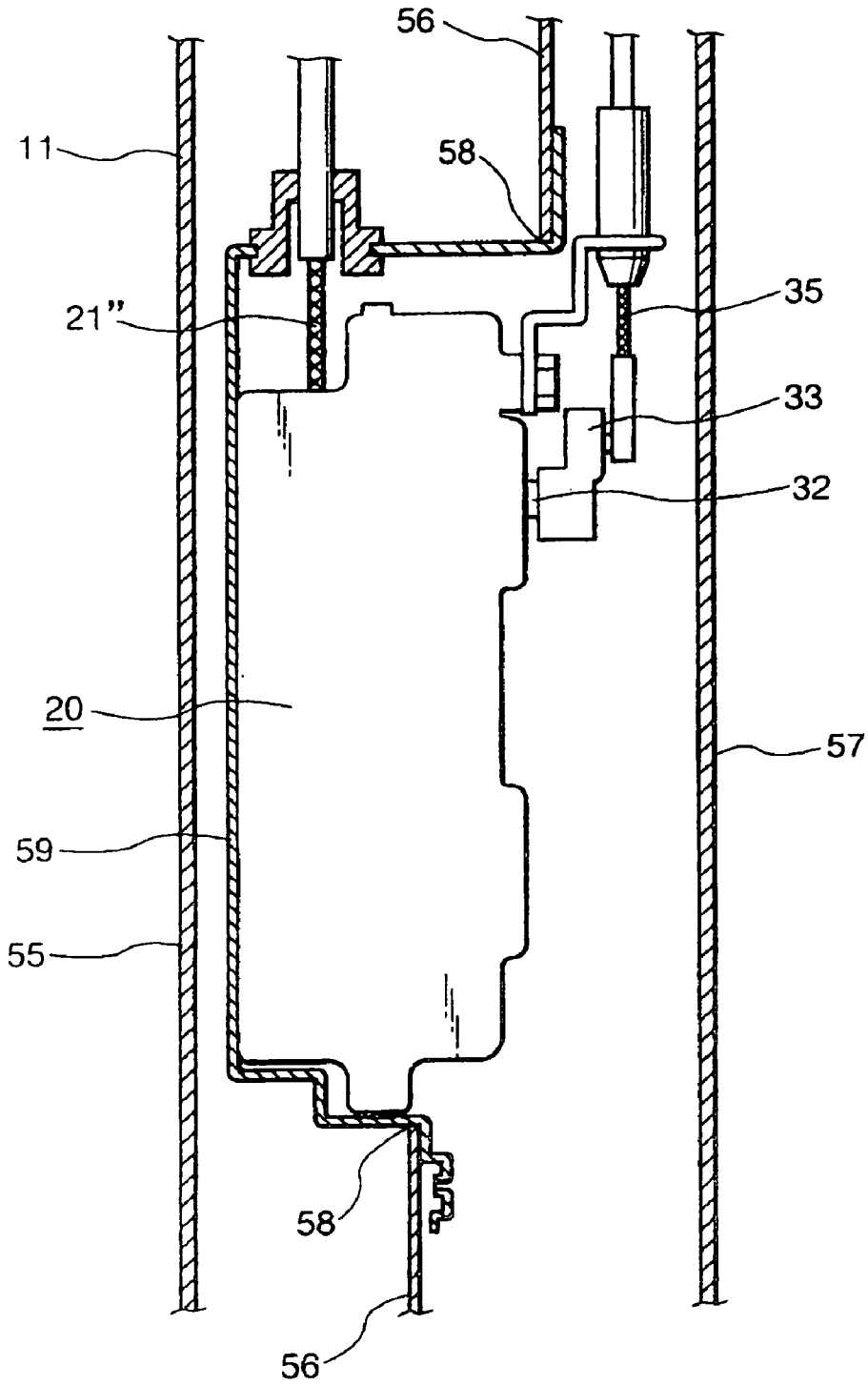
FIG. 9 is a sectional view showing a relation between the power unit and the sliding door.

As shown in FIG. 9, the sliding door 11 includes an outer metal panel 55, an inner metal panel 56, and a trim panel 57 attached to the interior surface of the inner metal panel 56. An opening 58 for mounting the power unit 20 is formed at a predetermined position of the inner metal panel 56. A mounting bracket 59 is attached to the opening 58, and the power unit 20 is fixed to the mounting bracket 59. The mounting bracket 59 has a water and dust proof structure without hole and protects the power unit 20 from rain water and dusts entering between the outer metal panel 55 and the inner metal panel 56.

Operation

When the cylindrical worm 25 is reversely rotated by the single common motor 24 at the time the sliding door 11 is located at the full-closed position, the first worm wheel 26 is rotated counterclockwise, and the second worm wheel 27 is rotated clockwise in FIG. 7. When the second clutch 34 is turned on in this state, the clockwise rotation of the second worm wheel 27 is transmitted to the second support shaft 32 to thereby rotate the swing arm 33 fixed to the second support shaft 32. When the swing arm 33 starts rotation, the release cable 35 is pulled a predetermined amount in the direction of the arrow A. With the above operation, the ratchet 39 of the rear latch unit 36 is rotated through the release cable 35, released from the latch 38, and unlatches the door latch unit 36. Further, when the sliding door 11 is provided with the front latch unit 46, the ratchet of the front latch unit 46 is also rotated by pulling the release cable 35, thereby the front latch unit 46 is unlatched, and the sliding door 11 is placed in the openable state. Note that the release cable 35 is pulled the predetermined amount in the direction of the arrow A by rotating the swing arm 33 a predetermined amount less than a half-rotation. The second clutch 34 is turned off after the swing arm 33 is rotated the predetermined amount, and the swing arm 33 is returned to the state shown by FIG. 7 by a means such as a spring provided separately.

When the rear latch unit 36 (and the front latch unit 46) are unlatched, the first clutch 31 is turned on. The first clutch 31 is preferably turned on just before the second clutch 34 is turned off. When the first clutch 31 is turned on, the counterclockwise rotation of the first worm wheel 26 is transmitted to the wire drum 30 to thereby also rotate the wire drum 30 counterclockwise in the door-opening direction. Accordingly, the door opening cable 21' is taken up and the door closing cable 21" is pulled out, thereby the sliding door 11 is slid in the door-opening direction, and when it reaches the full-open position, the first clutch 31 is turned off, and the motor 24 is also turned off.

Since the motor 24 rotates continuously without being stopped in a series of the door open operations, it can be prevented that a large load due to a motor start current continuously acts on a battery as in a conventional battery. Further, the continuous rotation of the motor 24 permits the sliding door 11 to be smoothly slid and opened after the rear latch unit 36 (and the front latch unit 46) have been unlatched.

When the cylindrical worm 25 is rotated by the single common motor 24 at the time the sliding door 11 is located at the full-open position, the first worm wheel 26 is rotated clockwise, and the second worm wheel 27 is rotated counterclockwise in FIG. 7. In this state, when the second clutch 34 is turned on, the counterclockwise rotation of the second worm wheel 27 is transmitted to the second support shaft 32 to thereby rotate the swing arm 33 fixed to the second support shaft 32. When the swing arm 33 starts rotation, the release cable 35 is pulled a predetermined amount in the direction of the arrow A. Accordingly, the ratchet of the full-open position holder 48 of the sliding door 11 is rotated through the release cable 35 and released from the latch to thereby unlatch the full-open position holder 48 so that the sliding door 11 is placed in a closable state. The second clutch 34 is turned off after the swing arm 33 is rotated the predetermined amount, and the swing arm 33 is returned to the state shown by FIG. 7 by the means such as the spring and the like provided separately. Although the swing arm 33 is rotated in a direction opposite to that of the previous time, the release cable 35 can be pulled the predetermined amount in the direction of the arrow A even if the swing arm 33 is rotated in any direction. Further, when the release cable 35 is pulled by the rotation of the swing arm 33, the ratchets of the rear and front latch units 36 and 46 are also rotated, in addition to the ratchet of the full-open position holder 48. However, since the output of the motor is sufficient to slide the sliding door 11, the output does not come short.

When the full-open position holder 48 is unlatched, the first clutch 31 is turned on. The first clutch 31 is preferably turned on just before the second clutch 34 is turned off. When the first clutch 31 is turned on, the clockwise rotation of the first worm wheel 26 is transmitted to the wire drum 30, thereby the wire drum 30 is also rotated clockwise in the door-closing direction, thereby the door closing cable 21" is taken up, and the door opening cable 21' is drawn out. With the above operation, the sliding door 11 is slid in the door-closing direction, and when the sliding door 11 reaches the half-latched position, the first clutch 31 is turned off, and the motor 24 is stopped as well as the power close device 44 is actuated, and thereafter the sliding door 11 is moved from the half-latched position to the full-latched position by the power close device 44.

In a series of the door close operations, the motor 24 is actuated from the full-open position to the half-latched position, and thereafter the motor of the power close device 44 is actuated. However, since a large time lag exists between the start of actuation of the motor 24 and the start of the motor of the power close device 44, no large load due to a motor start current continuously acts on the battery.

Therefore, since the respective ratchets can be released from the respective latches even if the swing arm 33, which pulls the release cable 35 in the direction of the arrow A, is rotated in any direction, the respective ratchets of the full-open position holder 48, the rear latch unit 36, and the front latch unit 46 can be released from the respective latches only by turning on the second clutch 34 regardless of the rotational direction of the motor 24 while it is being rotated.

Figure 11:
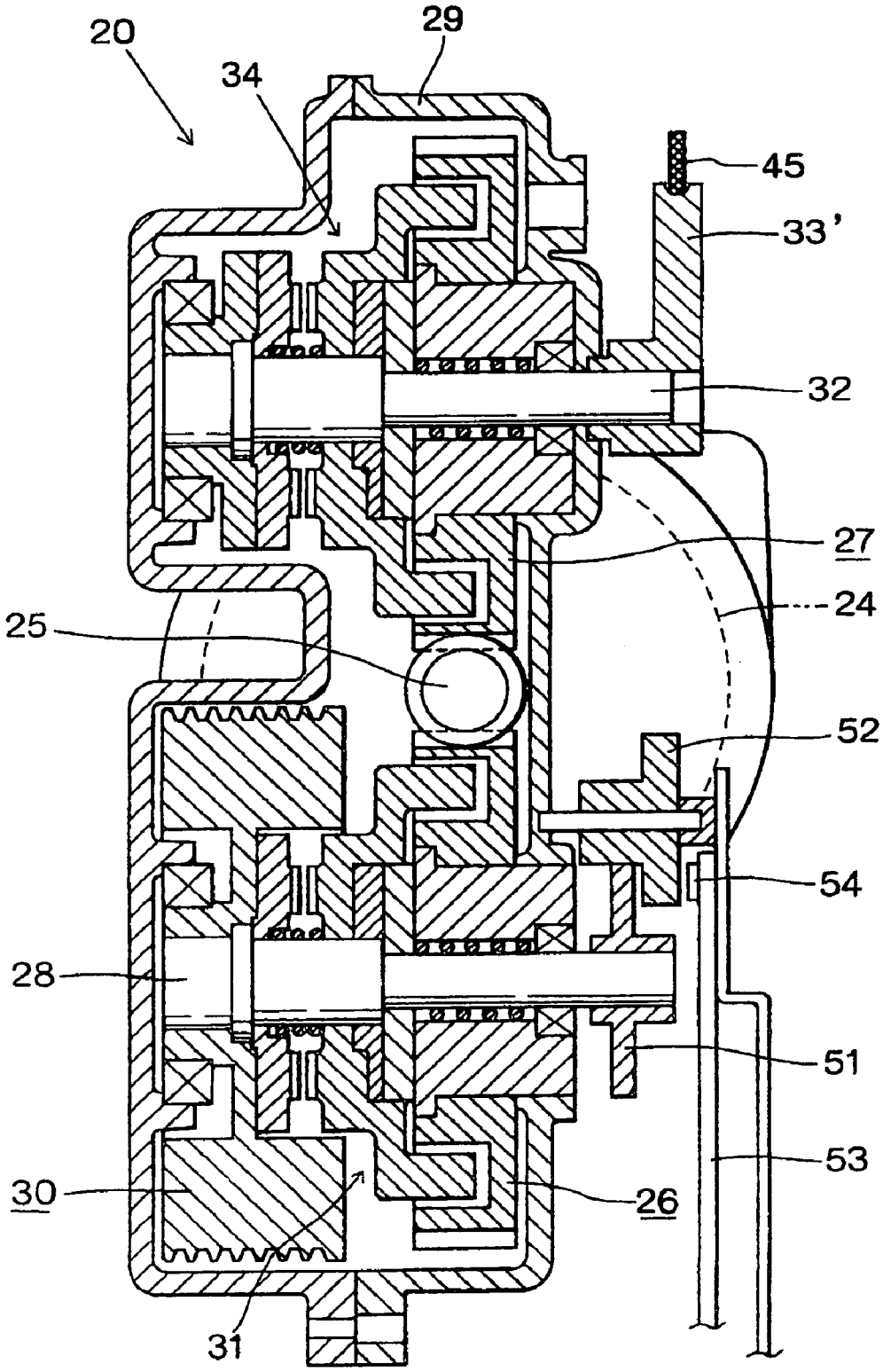
FIG. 11 is a sectional view of a power unit having a power close function and the power slide function.

Although the embodiment, in which the power unit 20 is provided with the power slide function and the power release function, has been explained above, the functions of the power unit 20 can be modified simply. When, for example, the power slide function is combined with the-power close function, since the pull amount of the release cable 35 in the power release function is different from that of the close cable 45 in the power close function, a cable take-up unit 33' having an appropriate shape is fixed to the second support shaft 32 in place of the swing arm 33 shown in FIGS. 7 and 8, and the close cable 45 is connected to the cable take-up unit 33' as shown in FIG. 11. With the above arrangement, the power slide function and the power close function, which require a large motor output, can be rationally combined with each other. In this case, since the power release function is omitted from the power unit 20, the power release device is separately prepared to pull the release cable 35. However, since a motor for the power release device is small in size having a small capacity, a problem of a conventional power device does not arise even if the small motor for the power release device and the motor 24 of the power unit 20 are started almost simultaneously.

Figure 12:
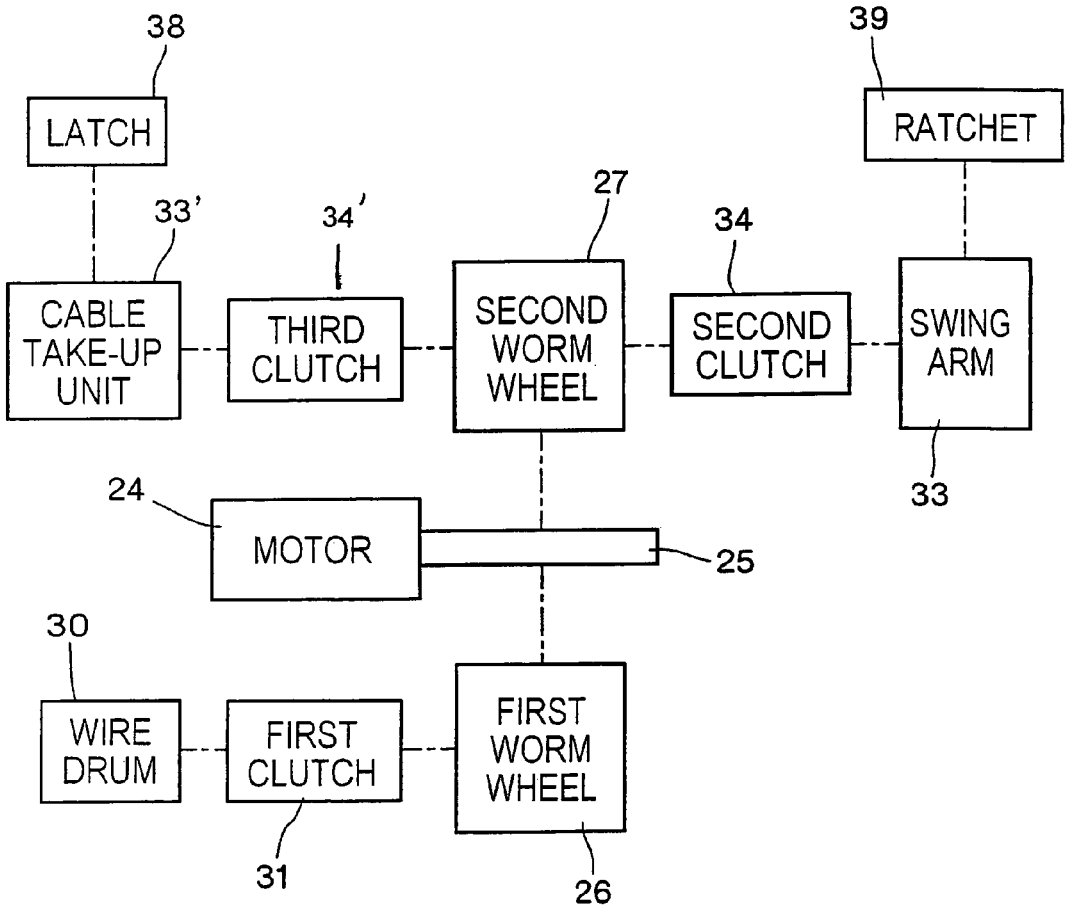
FIG. 12 is a schematic drawing showing the three clutches of the power device in cooperation.

Further, it is possible for the power unit 20 to be provided with the three functions of the power slide function, the power close function, and the power release function. In this case, the first or second support shaft 28 or 32 is newly provided with a cable take-up unit for pulling the close cable 45, and a third clutch shown in FIG. 12 is interposed between the cable take-up unit and the first worm wheel 26 or the second worm wheel 27.

Advantages

As described above, in the present invention, since the swing arm 33 and the wire drum 30 can be rotated, while the motor 24 is being continuously rotated, by controlling the first and second clutches 31 and 34, it can be prevented that a large load due to a motor start current continuously acts on the battery as in the conventional battery. Further, the continuous rotation of the motor 24 permits the sliding door 11 to be smoothly slid and opened after the rear latch unit 36 (and the front latch unit 46) have been unlatched.

Further, the release cable 35 can be pulled the predetermined amount in the direction of the arrow A by rotating the swing arm 33 about half in any direction. Accordingly, the respective ratchets of the full-open position holder 48, the rear latch unit 36, and the front latch unit 46 can be released from the respective latches only by turning on the second clutch 34 regardless of the rotational direction of the motor 24 while it is being rotated.

Further, the power unit 20, in which the power slide function and the power close function are combined with each other, can be arranged by the single motor 24.

Further, the power unit 20, which the power slide function, the power close function, and the power release function are combined one another, can be arranged by the single motor 24.

What is claimed is:

1. A power device engaged to a vehicle sliding door, comprising:

a power unit having a wire drum rotated by motor power;

a door opening cable and a door closing cable having a base end coupled with the wire drum, respectively;

the sliding door slidably attached to a vehicle body in a forward and door-closing direction and in a rearward and door-opening direction, said sliding door being slid in the door-closing direction or in the door-opening direction when the door opening cable and the door closing cable are taken up or drawn out by the rotation of the wire drum;

a rear door latch unit for keeping the sliding door at a full-closed position by being engaged with a rear striker fixed to the vehicle body;

a swing arm coupled with a ratchet of the rear door latch unit, said swing arm releasing the ratchet from a latch of the door latch unit when rotated;

a first clutch interposed between an output shaft of the motor and the wire drum; and a second clutch interposed between the output shaft of the motor and the swing arm, wherein the swing arm is rotated through the first clutch and the wire drum is successively rotated through the second clutch by the continuous rotation of the motor executed once.

2. The power device according to claim 1, wherein the swing arm can release the ratchet from the latch even if the motor is rotated in any direction.

3. The power device according to claim 2, further comprising:

a full-open position holder having a latch and a ratchet for keeping the sliding door at a full-open position by being engaged with a full-open striker fixed to the vehicle body, wherein the ratchet of the full-open position holder is also coupled with the swing arm, in addition to the ratchet of the rear door latch unit.

4. A power device engaged to a vehicle sliding door, comprising:

a power unit having a wire drum rotated by motor power;

a door opening cable and a door closing cable having a base end coupled with the wire drum, respectively;

the sliding door slidably attached to a vehicle body in a forward and door-closing direction and in a rearward and door-opening direction, said sliding door being slid in the door-closing direction or in the door-opening direction when the door opening cable and the door closing cable are taken up or drawn out by the rotation of the wire drum;

a door latch unit for keeping the sliding door at a full-closed position by being engaged with a rear striker fixed to the vehicle body;

a cable take-up unit coupled with a latch of the door latch unit, said cable take-up unit rotating the latch from a half-latched position to a full-latched position when rotated;

a first clutch interposed between an output shaft of the motor and the wire drum;

a second clutch interposed between the output shaft of the motor and the cable take-up unit, wherein the cable take-up unit is rotated through the first clutch, and the wire drum is successively rotated through the second clutch by the continuous rotation of the motor executed once.

5. A power device engaged to a vehicle sliding door, comprising:

a power unit having a wire drum rotated by motor power;

a door opening cable and a door closing cable having a base end coupled with the wire drum, respectively;

the sliding door slidably attached to a vehicle body in a forward and door-closing direction and in a rearward and door-opening direction, said sliding door being slid in the door-closing direction or in the door-opening direction when the door opening cable and the door closing cable are taken up or drawn out by the rotation of the wire drum;

a door latch unit for keeping the sliding door at a full-closed position by being engaged with a rear striker fixed to the vehicle body;

a swing arm coupled with a ratchet of the door latch unit, said swing arm releasing the ratchet from a latch of the door latch unit when rotated;

a cable take-up unit coupled with the latch of the door latch unit, said cable take-up unit rotating the latch from a half-latched position to a full-latched position when rotated;

a first clutch interposed between an output shaft of the motor and the wire drum;

a second clutch interposed between the output shaft of the motor and the swing arm;

a third clutch interposed between the output shaft of the motor and the cable take-up unit, wherein the swing arm is rotated through the first clutch and the wire drum is successively rotated through the second clutch by the continuous rotation of the motor executed once; and wherein the cable take-up unit is rotated through the first clutch and the wire drum is successively rotated through the second clutch by the continuous rotation of the motor executed once.

* * * * *